US005792247A

United States Patent [19]

Gillingham et al.

[11] Patent Number: 5,792,247

[45] Date of Patent: Aug. 11, 1998

[54] INTEGRATED RESONATOR AND FILTER APPARATUS

[75] Inventors: Gary R. Gillingham, Prior Lake; Daniel T. Risch, Burnsville; Joseph C. Tokar; Wayne M. Wagner, both of Apple Valley; Bernard A. Matthys, Apple Valley; Edward A. Steinbrueck, Eden Prairie, all of Minn.

[73] Assignee: Donaldson Company, Inc., Minneapolis, Minn.

[21] Appl. No.: 638,421

[22] Filed: Apr. 26, 1996

[51] Int. Cl.[6] ..... F02M 35/14

[52] U.S. Cl. ..... 96/386; 55/385.3; 55/DIG. 21; 181/231

[58] Field of Search ..... 55/276, 523, 385.3, 55/DIG. 21, DIG. 30; 181/231; 60/322

[56] References Cited

U.S. PATENT DOCUMENTS

| | | | |
|---|---|---|---|
| 1,729,135 | 9/1929 | Slauson | 55/234 |
| 2,038,071 | 4/1936 | Wilhelm | 96/118 |
| 2,190,886 | 2/1940 | Schaaf et al. | 55/489 |
| 3,020,977 | 2/1962 | Huppke et al. | 55/520 |
| 3,025,963 | 3/1962 | Bauer | 210/493.4 |
| 3,025,964 | 3/1962 | Summers et al. | 210/493.5 |
| 3,037,637 | 6/1962 | Bub | 210/487 |
| 3,112,184 | 11/1963 | Hollenbach | 210/493.4 X |
| 3,112,262 | 11/1963 | Parkinson | 210/130 |
| 3,858,793 | 1/1975 | Dudrey | 494/60 |
| 3,884,655 | 5/1975 | Coop | 55/276 |
| 4,410,427 | 10/1983 | Wydeven | 210/317 |
| 4,439,321 | 3/1984 | Taki et al. | 210/493.1 |
| 4,460,388 | 7/1984 | Fukami et al. | 55/524 X |
| 4,589,983 | 5/1986 | Wydevan | 55/521 X |
| 4,652,286 | 3/1987 | Kusuda et al. | 55/523 |
| 4,704,863 | 11/1987 | Abthoff et al. | 55/523 X |
| 4,713,097 | 12/1987 | Grawi et al. | 55/276 |
| 4,782,912 | 11/1988 | Wandless | 181/229 |
| 4,867,769 | 9/1989 | Wagner et al. | 55/DIG. 30 |
| 4,925,561 | 5/1990 | Ishii et al. | 210/493.3 |
| 4,936,413 | 6/1990 | Lee | 181/264 |
| 5,016,728 | 5/1991 | Zulawski | 181/229 |
| 5,106,397 | 4/1992 | Jaroszczyk et al. | 55/521 X |
| 5,112,372 | 5/1992 | Boeckermann et al. | 55/276 |
| 5,125,940 | 6/1992 | Stanhope et al. | 55/385.3 |
| 5,322,537 | 6/1994 | Nakamura et al. | 55/523 |
| 5,417,727 | 5/1995 | Bowen et al. | 55/522 X |
| 5,512,075 | 4/1996 | Ninomiya et al. | 55/521 X |

FOREIGN PATENT DOCUMENTS

| | | |
|---|---|---|
| 1193833 | 11/1959 | France . |
| 1207490 | 2/1960 | France . |
| 1366623 | 6/1964 | France . |
| 1586317 | 2/1970 | France . |
| 671 096 | 2/1939 | Germany . |
| 26 16 861 | 10/1976 | Germany . |
| 27 02 160 | 7/1978 | Germany . |
| 1 579 881 | 11/1980 | United Kingdom . |
| 1 579 882 | 11/1980 | United Kingdom . |
| 1 579 883 | 11/1980 | United Kingdom . |

*Primary Examiner*—Richard L. Chiesa

*Attorney, Agent, or Firm*—Merchant, Gould, Smith, Edell, Welter & Schmidt

[57] ABSTRACT

In integral filter and resonator apparatus includes filter elements positioned upstream of a Helmholtz resonator. The first embodiment includes filter elements positioned side by side within the housing. Other embodiments include a filter element with a tube which curves slightly downstream from the element. Another embodiment includes coupled chambers for attenuating the noise.

4 Claims, 15 Drawing Sheets

INTEGRATED RESONATOR AND FILTER APPARATUS

BACKGROUND OF THE INVENTION

1. Field of the Invention

The present invention is directed to an integrated filter and resonator apparatus for filtering the air and reducing the noise, and in particular to an apparatus which inserts inline into a duct.

2. Description of the Prior Art

Systems for filtering air and systems for reducing noise with engines such as internal combustion engines are well known. Internal combustion engines typically have ducts to direct air into the engine which usually include an intake snorkel, an air cleaner, an intake duct, and an intake manifold. In addition, a throttling mechanism or throttle body is found on spark ignited internal combustion engines.

The air cleaner component has evolved from filters with oil applied to the filter media for trapping particulate to pleated filters in annular configurations positioned on top of the engine. Filters in present automobiles typically utilized are panel-type filters configured to fit into crowded spaces of smaller engine compartments. However, it can be appreciated that more efficient and smaller filters are needed with current and future vehicle designs which can be placed inline into a duct.

Helmhotz resonator devices require a large volume forming a resonator chamber and a connection type to the source of the noise. However, the large volume required takes up valuable space in the engine compartment which is at a premium in today's automobile designs. In addition, since the resonator chamber typically requires a large volume, it may be placed distant from the noise source, thereby requiring duct work leading to the chamber taking up additional volume.

Since filters and resonators typically each require an enlarged chamber for satisfactory performance, it can be appreciated that the enlarged volume could be combined to decrease the overall volume required for separate filter and resonator devices. In addition to the volume required for two separate devices, the additional volume is required for duct work for two devices rather than a single, combined device.

It can be seen then, that a new and improved resonator and filtering device is needed which occupies less volume than traditional devices. Such a device should provide for using a single volume for housing both the resonator and the filter device. In addition, the filter apparatus should provide for substantially inline straight-through flow which can lead into a resonator device. The apparatus should also be insertable directly inline into a duct or other chamber while occupying less volume. The present invention addresses these as well as others associated with filter and resonator devices.

SUMMARY OF THE INVENTION

The present invention is directed to an integrated resonator filter apparatus for filtering fluid and reducing noise. The apparatus includes a fluted filter element in a preferred embodiment. Downstream from the filter element is a resonator device integrated into the same housing. A Helmholtz resonator having an enclosure with a straight tube of such dimensions that the enclosure resonates at a single frequency determined by the geometry of the resonator is used in several embodiments. The resonator device is generally directly coupled to a duct leading to an engine plenum or other noise source. The resonator and filter are in an integrally-formed device sharing a housing in a preferred embodiment which is insertable inline into a duct, serving as a portion of the duct.

These features of novelty and various other advantages which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals indicate corresponding elements throughout the several views.

DETAILED DESCRIPTION OF THE PREFERRED EMBODIMENT

Figure 1:
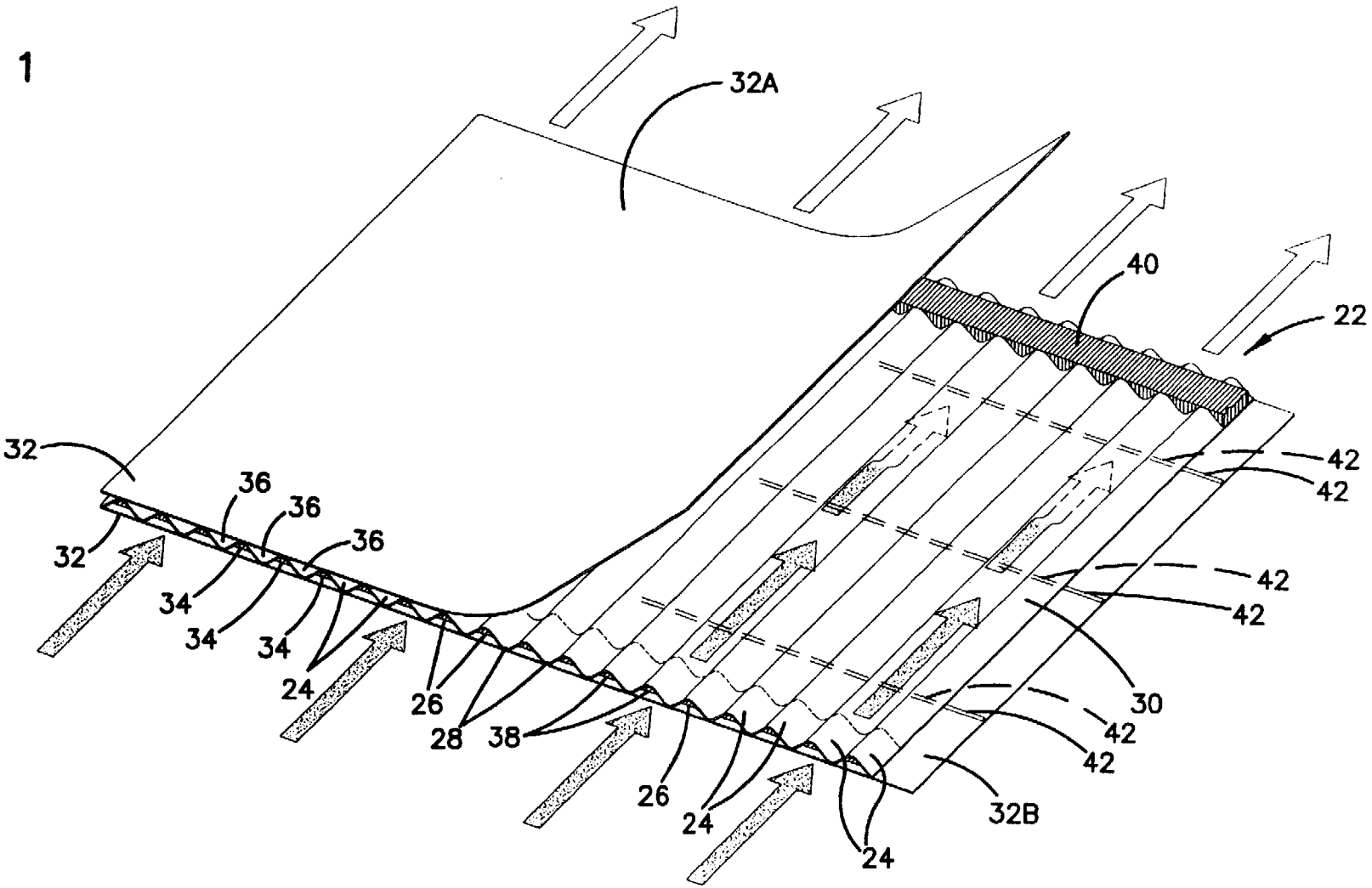
FIG. 1 shows a perspective view of double-faced fluted filter media for the filter apparatus according to the principles of the present invention.

Referring now to the drawings, and in particular to FIG. 1, there is shown a portion of a layer of double-faced permeable fluted filter media, generally designated 22. The fluted filter media 22 includes a multiplicity of flutes 24 which form a modified corrugated-type material. The flute chambers 24 are formed by a center fluting sheet 30 forming alternating peaks 26 and troughs 28 mounting between facing sheets 32, including a first facing sheet 32A and a second facing sheet 32B. The troughs 28 and peaks 26 divide the flutes into an upper row and lower row. In the configuration shown in FIG. 1, the upper flutes form flute chambers 36 closed at the downstream end, while upstream closed end flutes 34 are the lower row of flute chambers. The fluted chambers 34 are closed by first end bead 38 filling a portion of the upstream end of the flute between the fluting sheet 30 and the second facing sheet 32B. Similarly, a second end bead 40 closes the downstream end of alternating flutes 36. Adhesive tacks 42 connect the peaks 26 and troughs 28 of the flutes 24 to the facing sheets 32A and 32B. The flutes 24 and end beads 38 and 40 provide a filter element which is structurally self-supporting without a housing.

When filtering, unfiltered fluid enters the flute chambers 36 which have their upstream ends open, as indicated by the shaded arrows. Upon entering the flute chambers 36, the unfiltered fluid flow is closed off by the second end bead 40. Therefore, the fluid is forced to proceed through the fluting sheet 30 or facing sheets 32. As the unfiltered fluid passes through the fluting sheet 30 or face sheets 32, the fluid is filtered through the filter media layers, as indicated by the unshaded arrows. The fluid is then free to pass through the flute chambers 34, which have their upstream end closed and to flow out the downstream end out the filter media 22. With the configuration shown, the unfiltered fluid can filter through the fluted sheet 30, the upper facing sheet 32A or lower facing sheet 32B, and into a flute chamber 34 open on its downstream side.

Figure 2A:
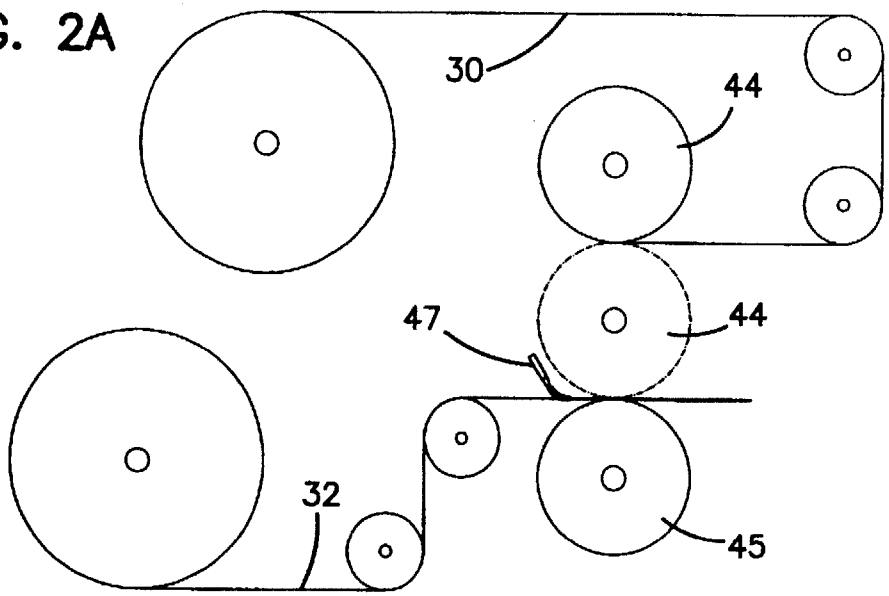
FIGS. 2A–2B show diagrammatic views of the process of manufacturing the filter media shown in FIG. 1.
Figure 2B:
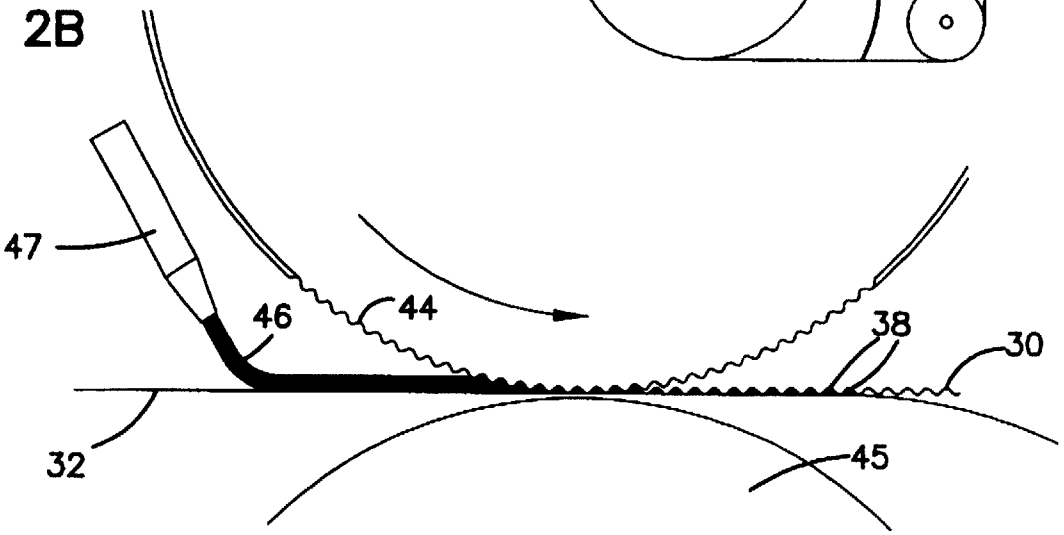

Referring now to FIGS. 2A–2B, the manufacturing process for fluted filter media which may be stacked or rolled to form filter elements, as explained hereinafter, is shown. It can be appreciated that when the filter media is layered or spiraled, with adjacent layers contacting one another, only one facing sheet 32 is required as it can serve as the top for one fluted layer and the bottom sheet for another fluted layer. Therefore, it can be appreciated that the fluted sheet 30 need be applied to only one facing sheet 32.

As shown in FIG. 2A, a first filtering media sheet 30 is delivered from a series of rollers to opposed crimping rollers 44 forming a nip. The rollers 44 have intermeshing wavy surfaces to crimp the first sheet 30 as it is pinched between the rollers 44 and 45. As shown in FIG. 2B, the first now corrugated sheet 30, and a second flat sheet of filter media 32 are fed together to a second nip formed between the first of the crimping rollers 44 and an opposed roller 45. A sealant applicator 47 applies a sealant 46 along the upper surface of the second sheet 32 prior to engagement between the crimping roller 44 and the opposed roller 45. At the beginning of a manufacturing run, as the first sheet 30 and second sheet 32 pass through the rollers 44 and 45, the sheets fall away. However as sealant 46 is applied, the sealant 46 forms first end bead 38 between the fluted sheet 30 and the facing sheet 32. The troughs 28 have tacking beads 42 applied at spaced intervals along their apex or are otherwise attached to the facing sheet 32 to form flute chambers 34. The resultant structure of the facing sheet 32 sealed at one edge to the fluted sheet 30 is single-faced layerable filter media 48, shown in FIG. 4.

Figure 3:
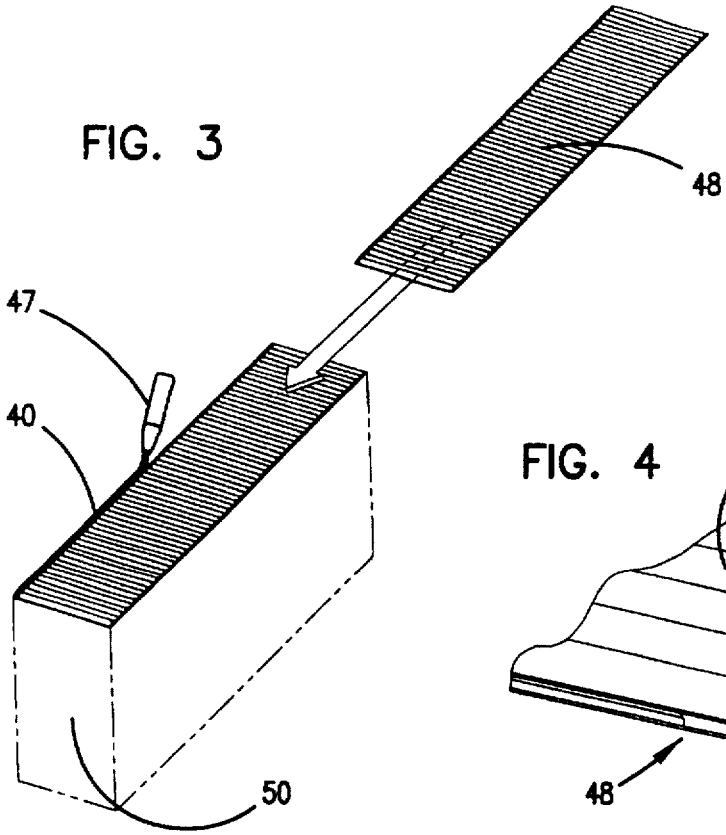
FIG. 3 shows a perspective view of the fluted filter media layered in a block configuration according to the principles of the present invention.
Figure 4:
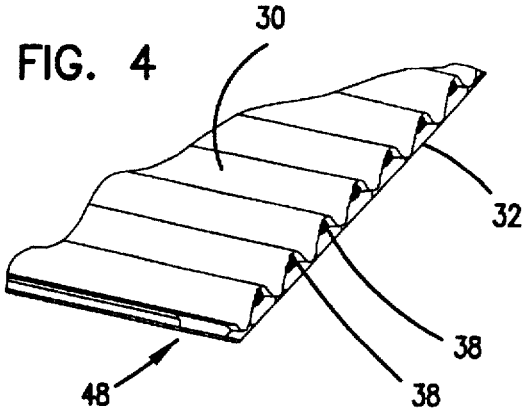
FIG. 4 shows a detail perspective view of a layer of single-faced filter media for the filter element shown in FIG. 3.

Referring now to FIG. 3, it can be appreciated that the single-faced filter media layer 48 having a single backing sheet 32 and a single end bead 38 can be layered to form a block-type filter element, generally designated 50. A second bead 40 is laid down on an opposite edge outside of the flutes so that adjacent layers 48 can be added to the block 50. In this manner, first end beads 38 are laid down between the top of the facing sheet and the bottom of the fluted sheet 30, as shown in FIG. 4, while the space between the top of the fluting sheet 30 and the bottom of the facing sheet 32 receives a second bead 40. In addition, the peaks 26 are tacked to the bottom of the facing sheet 32 to form flutes 36. In this manner, a block of fluted filter media 50 is achieved utilizing the fluted layers 48 shown in FIG. 4. The filter element 50 includes adjacent flutes having alternating first closed ends and second closed ends to provide for substantially straight-through flow of the fluid between the upstream flow and the downstream flow.

Figure 5:
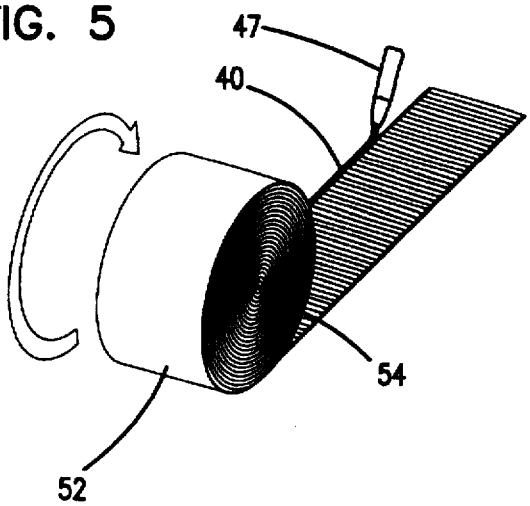
FIG. 5 shows a perspective view of the fluted filter media spiraled in a cylindrical configuration according to the principles of the present invention.
Figure 6:
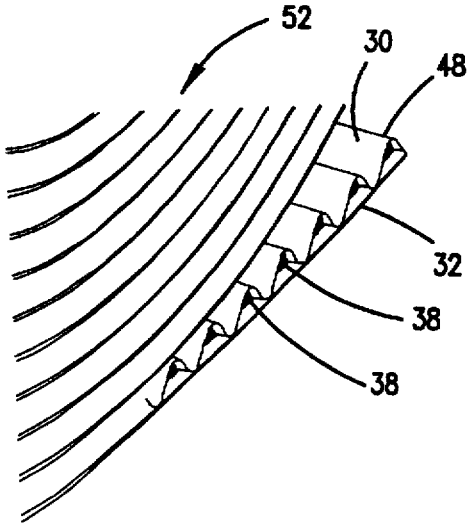
FIG. 6 shows a detail perspective view of a portion of the spiraled fluted filter media for the filter element shown in FIG. 5.

Turning now to FIGS. 5 and 6, it can be appreciated that the single-faced filter media 48 shown in FIG. 4 can be spiraled to form a cylindrical filtering element 52. The cylindrical filter element 52 is wound about a center mandrel 54 or other element to provide a mounting member for winding, which may be removable or left to plug the center. It can be appreciated that non-round center winding members may be utilized for making other filtering element shapes, such as filter elements having an oblong or oval profile. As a first bead 38, as shown in FIG. 4, has already been laid down on the filter media layer 48, it is necessary to lay down a second bead 40 with the sealing device 47, shown in FIG. 5, at a second end on top of the fluted layer 30. Therefore, the facing sheet 32 acts as both an inner facing sheet and exterior facing sheet, as shown in detail in FIG. 6. In this manner, a single facing sheet 32 wound in layers is all that is needed for forming a cylindrical fluted filtering element 52. It can be appreciated that the outside periphery of the filter element 52 must be closed to prevent the spiral from unwinding and to provide an element sealable against a housing or duct. Although in the embodiment shown, the single faced filter media layers 48 are wound with the flat sheet 32 on the outside, there may be applications wherein the flat sheet 32 is wound on the inside of the corrugated sheet 30.

Figure 7:
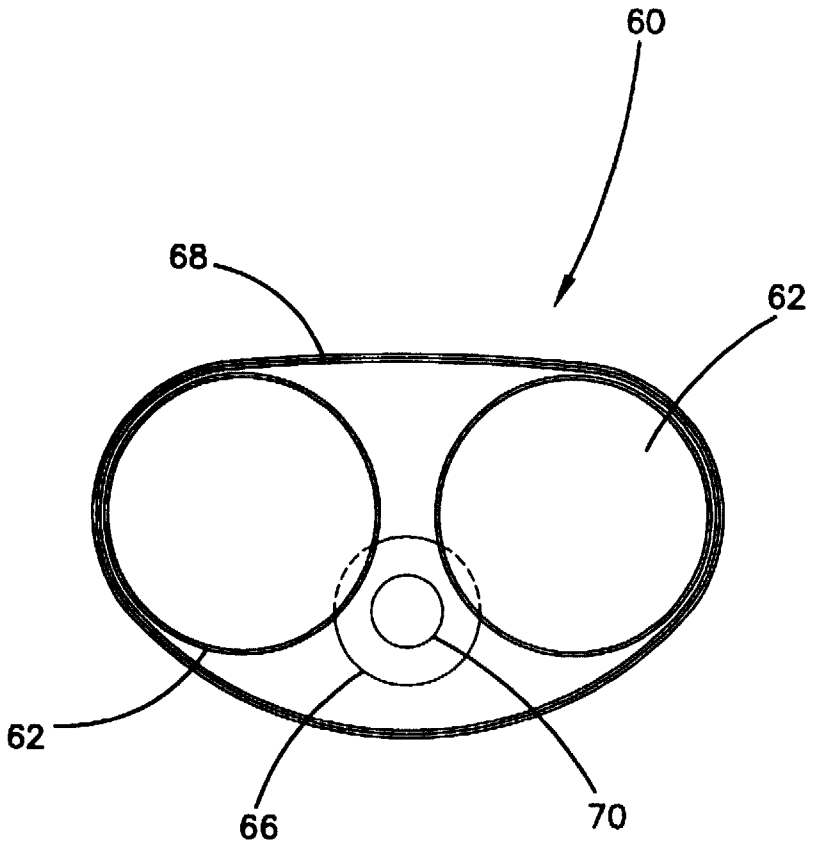
FIG. 7 shows an end view of a first embodiment of a resonator and filter apparatus according to the principles of the present invention.
Figure 8:
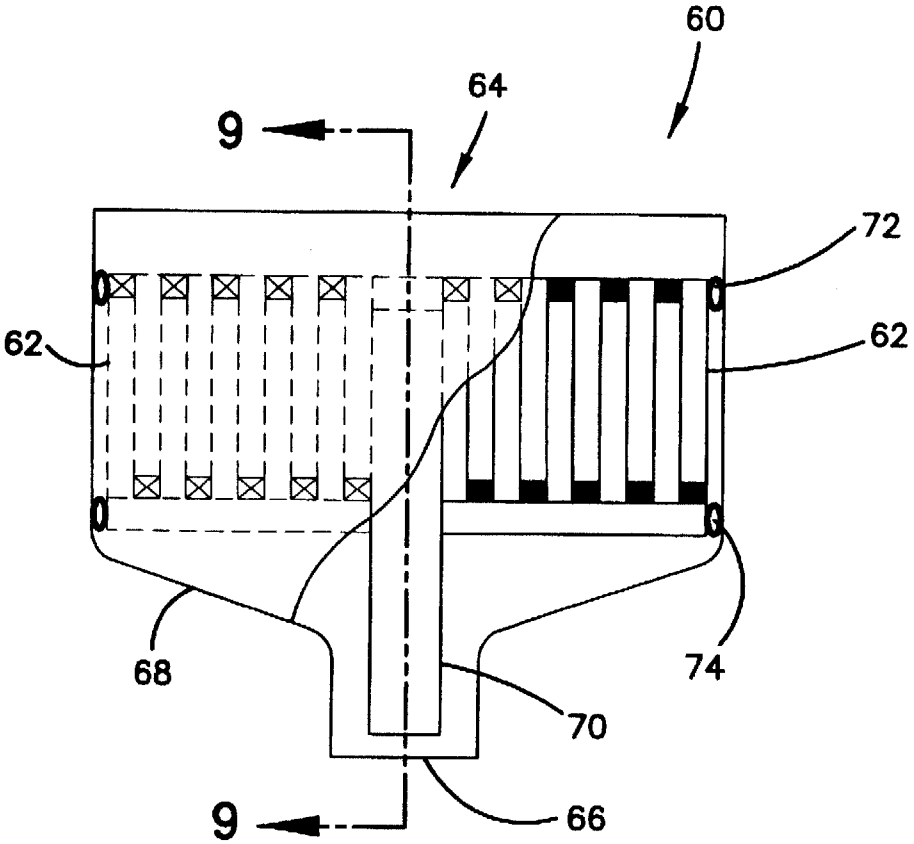
FIG. 8 shows a top plan view partially broken away of the resonator and filter apparatus shown in FIG. 7.
Figure 9:
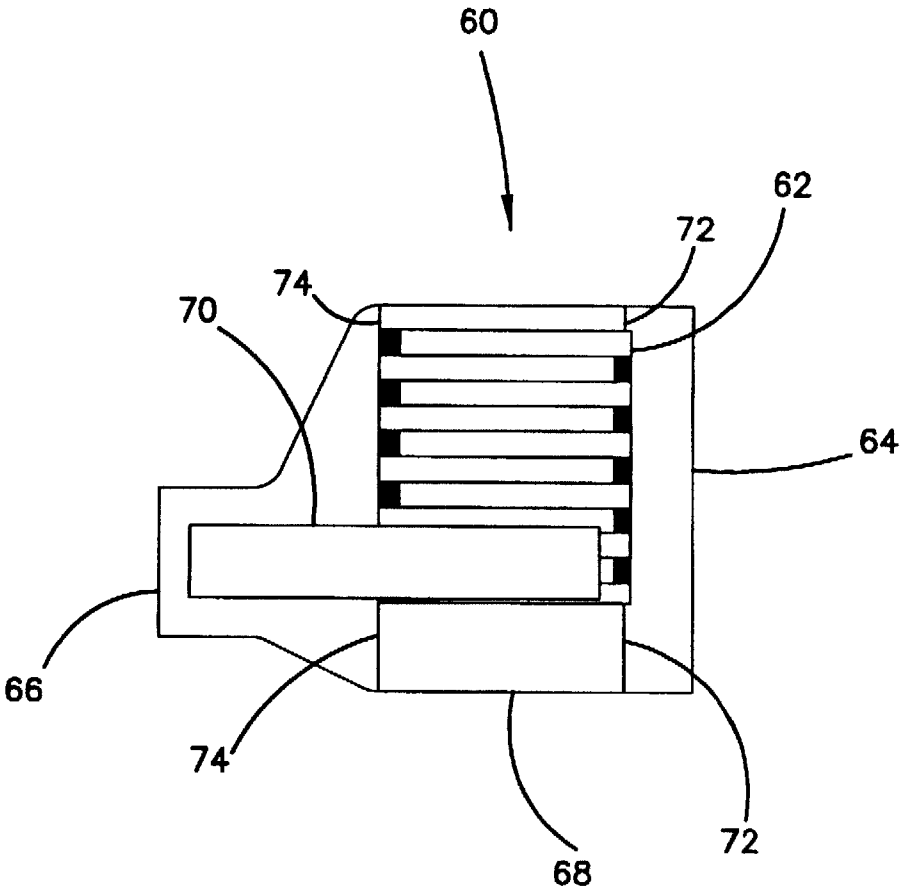
FIG. 9 shows a side sectional view of the resonator and filter apparatus taken along line 9—9 of FIG. 8.

Referring now to FIGS. 7–9, there is shown a first embodiment of an integrated filter and Helmholtz resonator apparatus, generally designated 60. The filter and noise control apparatus 60 includes filter elements 62 arranged as parallel fluid flow paths. In the preferred embodiment, the filter elements 62 are spiraled, fluted filter elements, as shown in FIGS. 5 and 6. Air enters the elements 62 at an enlarged inlet 64 and exits at a reduced outlet 66. A housing 68 retains the elements in a side-by-side arrangement and a coaxial Helmholtz resonator tube 70 mounts intermediate and offset from the filter elements 62 and substantially aligned with the outlet 66. Gaskets 72 and 74 retain the filter elements in a sealed configuration which forces the fluid through the elements and prevents contaminants from bypassing the filter elements 62. Although the integral filter and resonator apparatus 60 is shown alone, it can be appreciated that additional ducting may be connected to the inlet 64 to draw fluid from remote locations.

In addition to the coaxial resonator tube 70, the volume surrounding the filter element 62 creates a Helmholtz resonator volume that can be tuned to control the induction noise created by the engine's operation. The configuration of the coaxial resonator tube 70 is on the outlet side of the filter element 62 to control noise passed directly from an engine downstream. The coaxial design improves the coupling path of the Helmholtz resonator to the engine noise which propagates directly through the plenum to the downstream side of the filter element 62.

Figure 10:
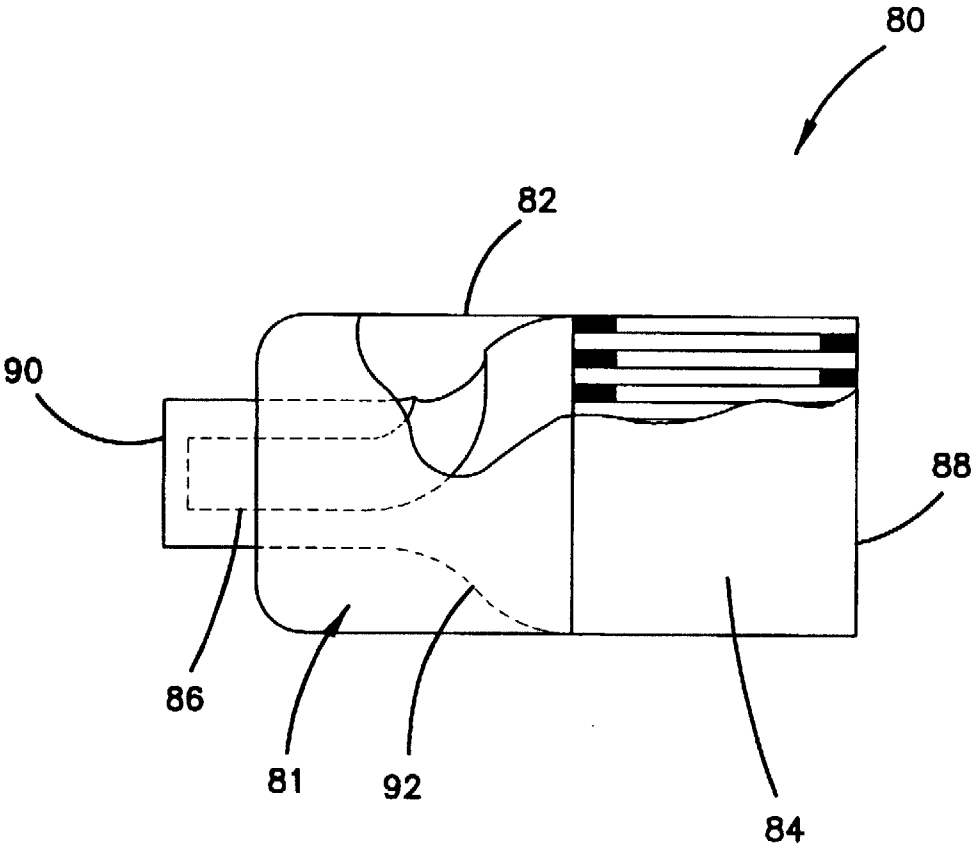
FIG. 10 shows a side elevational view partially broken away of a second embodiment of a resonator and filter apparatus.
Figure 11:
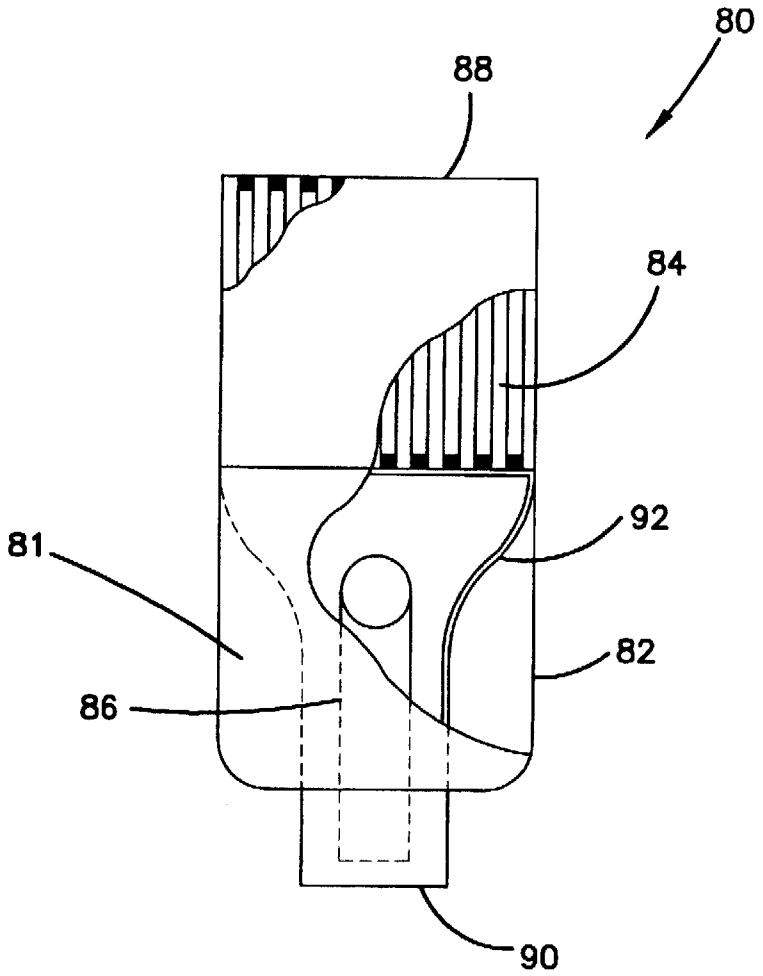
FIG. 11 shows a top plan view partially broken away of the resonator and filter apparatus shown in FIG. 10.

Referring now to FIGS. 10–11, there is shown a second embodiment of the integrated filter/Helmholtz resonator apparatus, generally designed 80. The resonator and filter apparatus 80 includes a housing 82 with a filter element 84, a Helmholtz resonator volume 81, and a coaxial Helmholtz resonator tube 86. In the embodiment shown in FIGS. 10–11, the filter element 84 is a substantially rectangular block type filter utilizing the fluted filter media 50, as shown in FIG. 3. Fluid enters the housing 82 at an inlet 88 and exits at an outlet 90. The outlet 90 couples directly to the engine induction plenum in a preferred embodiment. Although the filter element 84 shown has a square cross-section profile, it can be appreciated that this profile can be formed in a suitable common shape to optimize the filter loading area and utilize the space available.

The area downstream from the filter element 84 includes a narrowing chamber 92 surrounding the coaxial Helmholtz resonator tube 86. The coaxial resonator tube extends substantially with the prevailing direction of flow and bends upward at its upstream end to engage an orifice in the wall of the narrowing chamber 92. It can be appreciated that the volume between the housing 82 and chamber 92 form the Helmholtz resonator volume 81.

Figure 13:
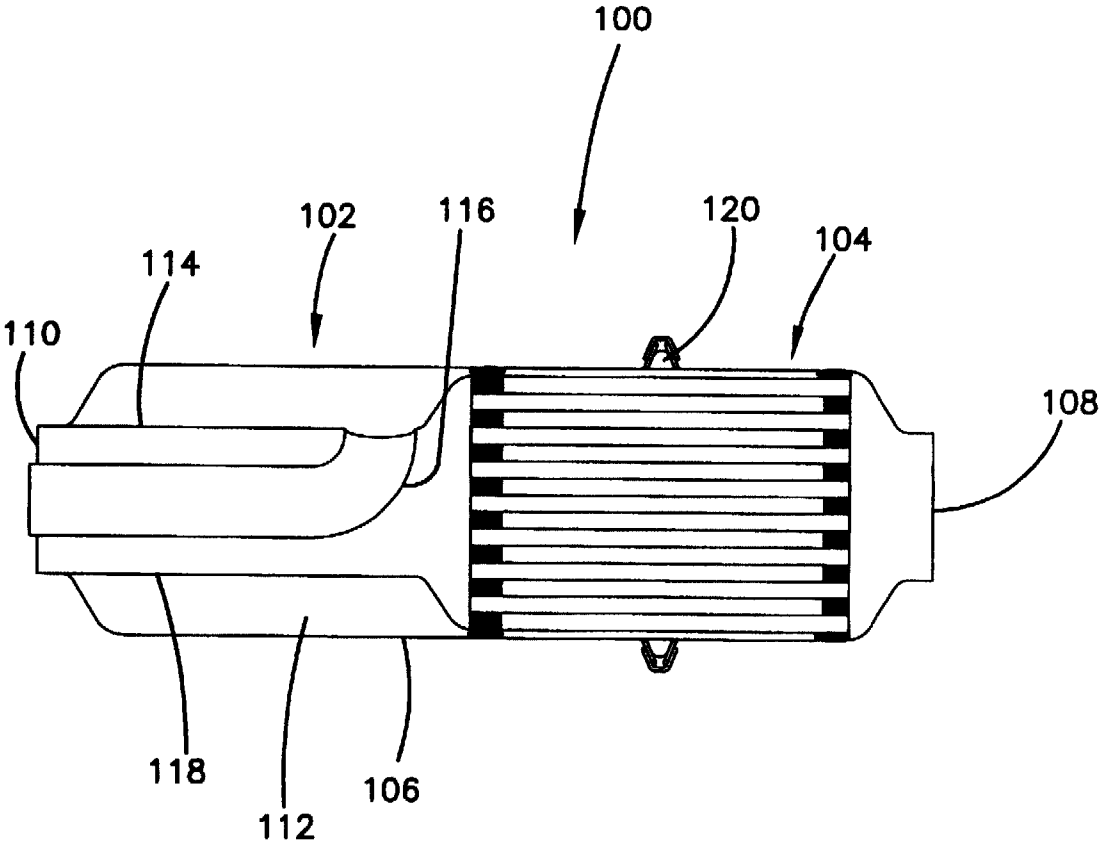
FIG. 13 shows a side sectional view taken along line 13—13 of FIG. 12.
Figure 12:
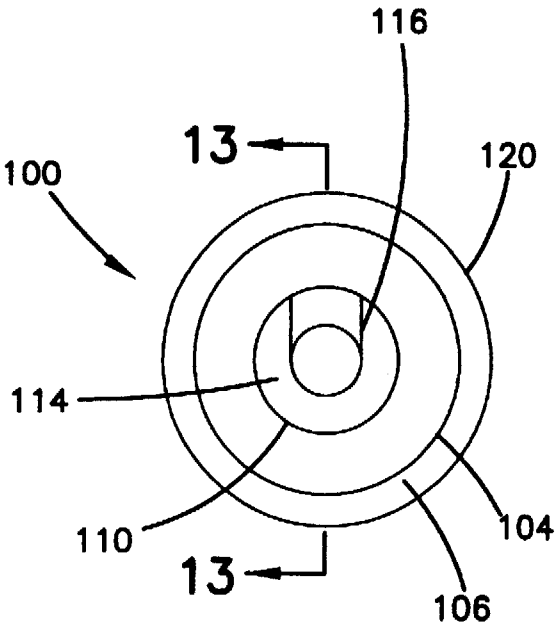
FIG. 12 shows an end elevational view of a third embodiment of a resonator and filter apparatus according to the principles of the present invention.

Referring now to FIGS. 12 and 13, there is shown a third embodiment of an integral filter and Helmholtz resonator apparatus, generally designed 100. The resonator and filter 100 includes a tandem Helmholtz resonator 102 and a filter portion 104 upstream of the resonator portion 102. A housing 106 includes an inlet 108 proximate the filter 104 and an outlet 110 downstream from the resonator portion 102. The Helmholtz resonator 102 includes a volume 112 and a coaxial tube 114 substantially coaxial with the outlet 110 and including an upstream end portion 116 bending to extend radially to connect to an orifice in the wall of a resonating volume chamber 118. The filter 104 may include a radial gasket 120 forming a seal around the periphery of the filter 104 with the housing 106. The seal 120 is integrally formed to the body of filter element 104 in a preferred embodiment. In the preferred embodiment, the filter 104 is a fluted filter element, as shown in FIGS. 5 and 6. The outlet 110 is preferably directly linked to an engine intake plenum when used with internal combustion engines.

It can be appreciated that with the embodiment shown in FIGS. 12 and 13, the tandem Helmholtz resonator filter apparatus 100 can be coupled with an intake duct or snorkel to require very little additional volume from an engine compartment. In this manner, the engine may have an intake located outside the engine compartment while the tandem resonator and filter apparatus 100 is located within the engine compartment.

Figure 15:
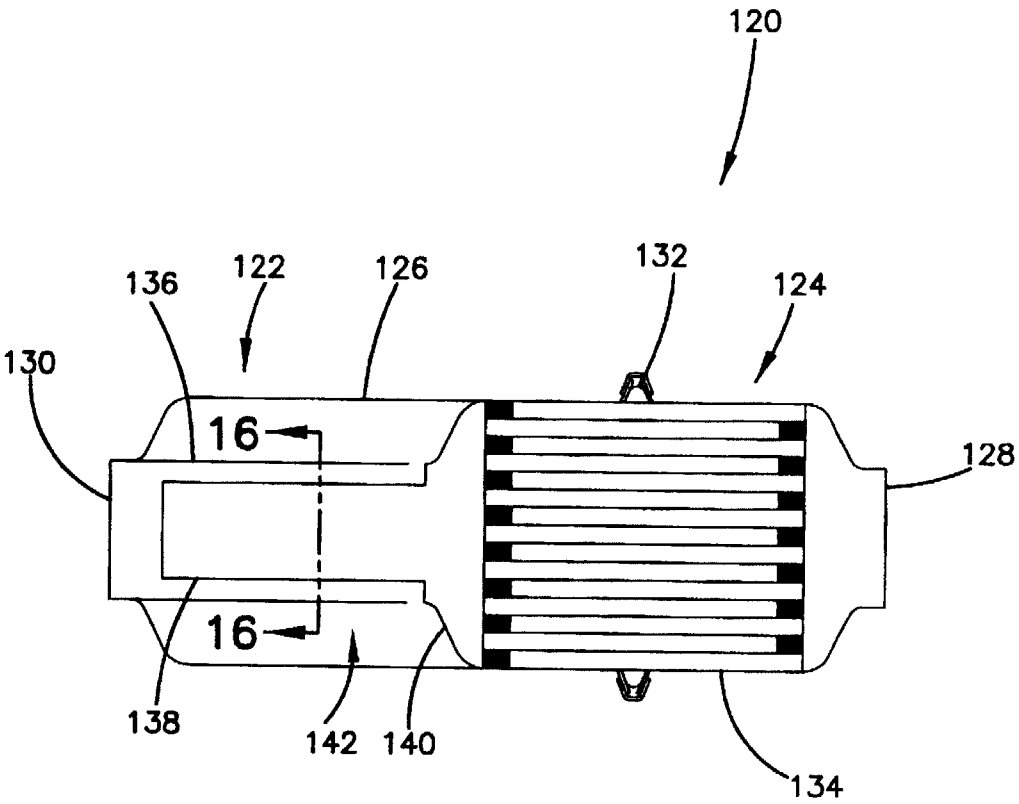
FIG. 15 shows a sectional view of the resonator and filter apparatus taken along line 15—15 of FIG. 14.
Figure 14:
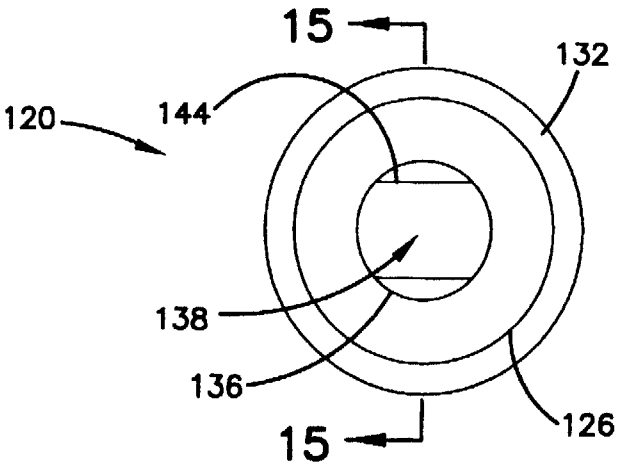
FIG. 14 shows an end elevational view of a fourth embodiment of a resonator and filter apparatus according to the principles of the present invention.
Figure 16:
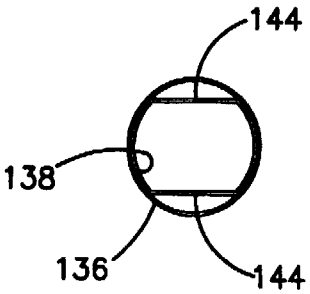
FIG. 16 shows a sectional view taken through line 16—16 of the resonator of the resonator and filter apparatus shown in FIG. 15.

Referring now to FIGS. 14–16, there is shown a fourth embodiment of a integral filter and Helmholtz resonator apparatus, generally designed 120. As with the embodiment shown in FIGS. 12 and 13, the resonator and filter apparatus 120 includes a Helmholtz resonator 122 and filter portion 124. A housing 126 includes an inlet 128 and an outlet 130. The filter may include a gasket 132 which forms a seal between the housing 126 and the periphery of a filter element 134. The gasket 132 provides for removing the upstream end of the housing 126 and replacing the filter element 134.

The Helmholtz resonator 122 includes an annular tube 136 which extends from the outlet 130 upstream into the resonator portion 122. In addition, a coaxial tube 138 extends downstream into the annular tube 136. The annular tube 136 opens at its upstream end between a widening area 140 of the coaxial tube 138 and the Helmholtz resonator volume 142. In addition, the coaxial tube 138 opens at the downstream end to the annular tube 136. Therefore, an open annular passage is formed between the outlet 130 at the downstream end and the Helmholtz resonator volume 142 at the upstream end. By sizing the coupling areas, the Helmholtz tube created by tubes 136 and 138, and the resonator 142 to match the wave lengths of the given noise frequencies, the noise can be greatly reduced with the present invention. In addition, the previous advantages from the other embodiments relating to positioning of the intake and volume required are retained. As shown in FIG. 16, the coaxial tube may include flattened side portions 144 which further reduce the size of the passage between the coaxial tube 136 and the annular tube 138. In this manner, two opposing top and bottom chambers, as shown in FIG. 16, are created for the Helmholtz connecting tube to the resonator volume 142. This provides for additional sound reduction tuning and for greater precision in matching the targeted noise wavelengths.

Figure 18:
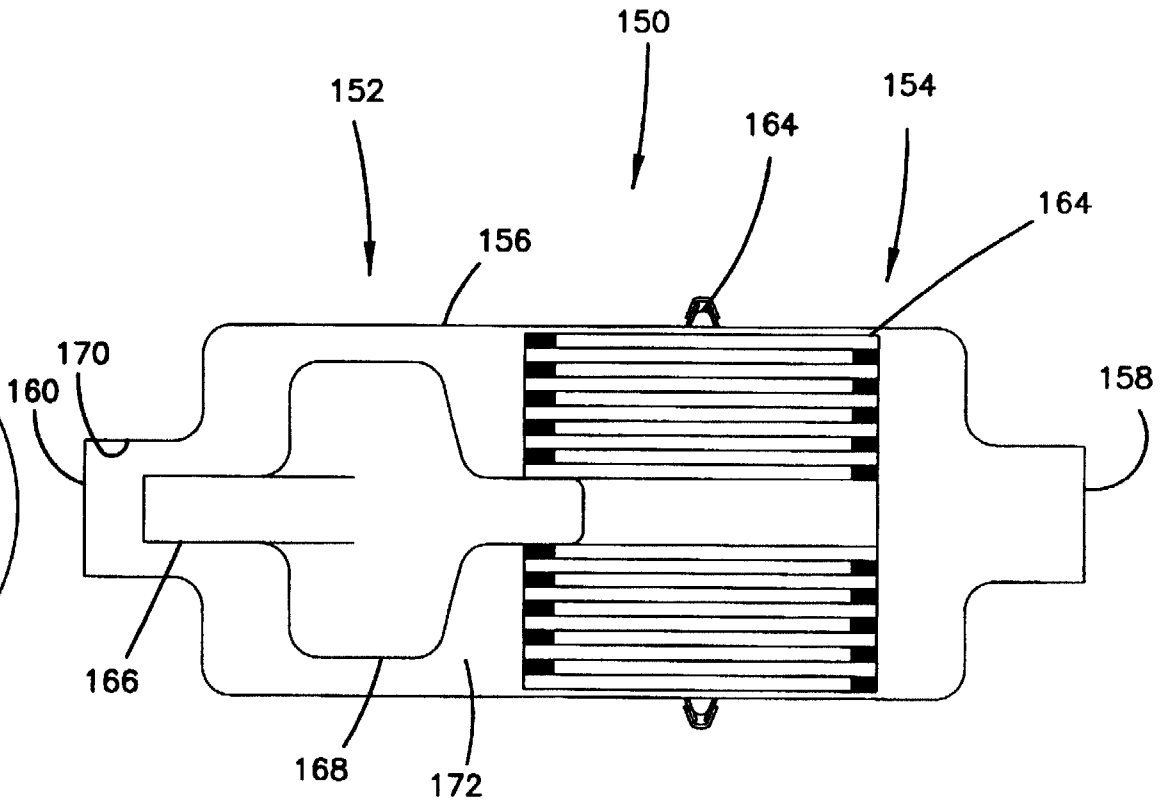
FIG. 18 shows a side sectional view of the resonator and filter apparatus taken along line 18—18 of FIG. 17.
Figure 17:
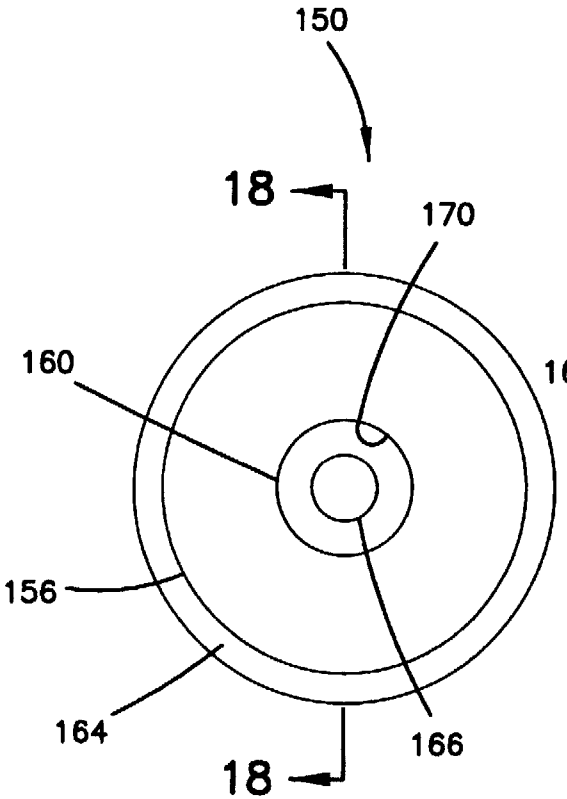
FIG. 17 shows an end elevational view of a fifth embodiment of a resonator and filter apparatus according to the principles of the present invention.

Referring now to FIGS. 17 and 18, there is shown a fifth embodiment of an integral Helmholtz resonator-filter apparatus, generally designed 150. The integral resonator filter apparatus 150 includes a Helmholtz resonator 152 and a filter portion 154. A housing 156 includes an inlet 158 and an outlet 160.

In the preferred embodiment, a filter element 162 is a cylindrical fluted filter type element, as shown in FIGS. 5 and 6. The fluted filter element 162 preferably includes a gasket 164 intermediate the filter element 160 and the housing 156. As with the other embodiments, a Helmholtz resonator 152 is downstream from the filter element 162. The Helmholtz resonator 152 includes a communication tube 166 extending to a volume 168 upstream from the communication tube 166. The communication tube extends into the outlet 160. A second resonating structure includes coupled chambers having a communication chamber 170 at the outlet 160 which has the communication tube 166 extending partially thereinto. In addition, the communication chamber 170 extends downstream beyond the communication tube 166 receiving flow from the outlet 160. Within the housing 156 is a resonating chamber 172 surrounding the enlarged portion of the Helmholtz volume 168. The various resonator structures provide for noise reduction over a wide frequency range. The various elements may be configured so that particular frequencies over the wide range may be precisely tuned.

Figure 19:
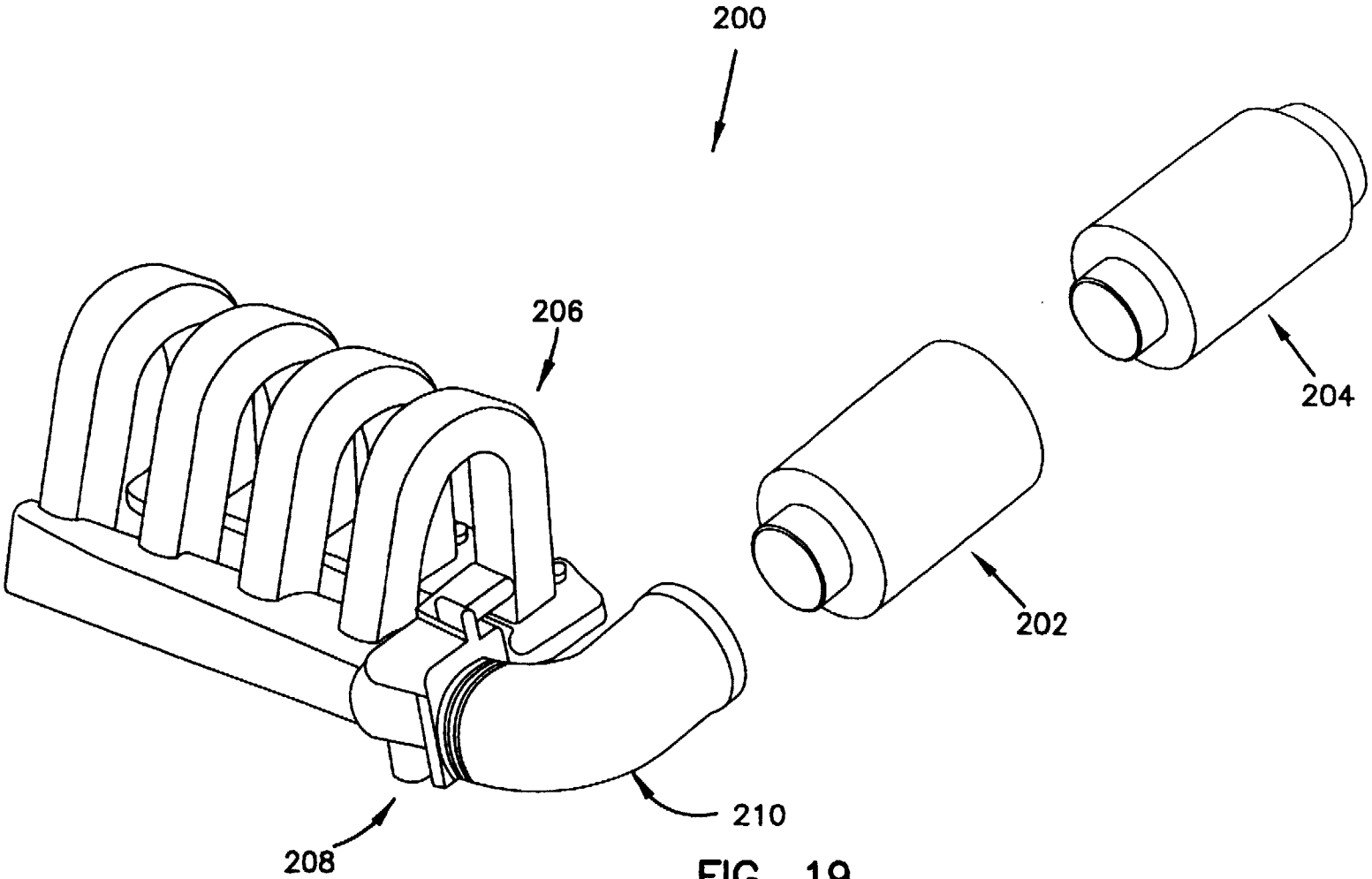
FIG. 19 shows a perspective view of a modular filter/resonator attached to an intake manifold of a typical internal combustion engine.
Figure 20:
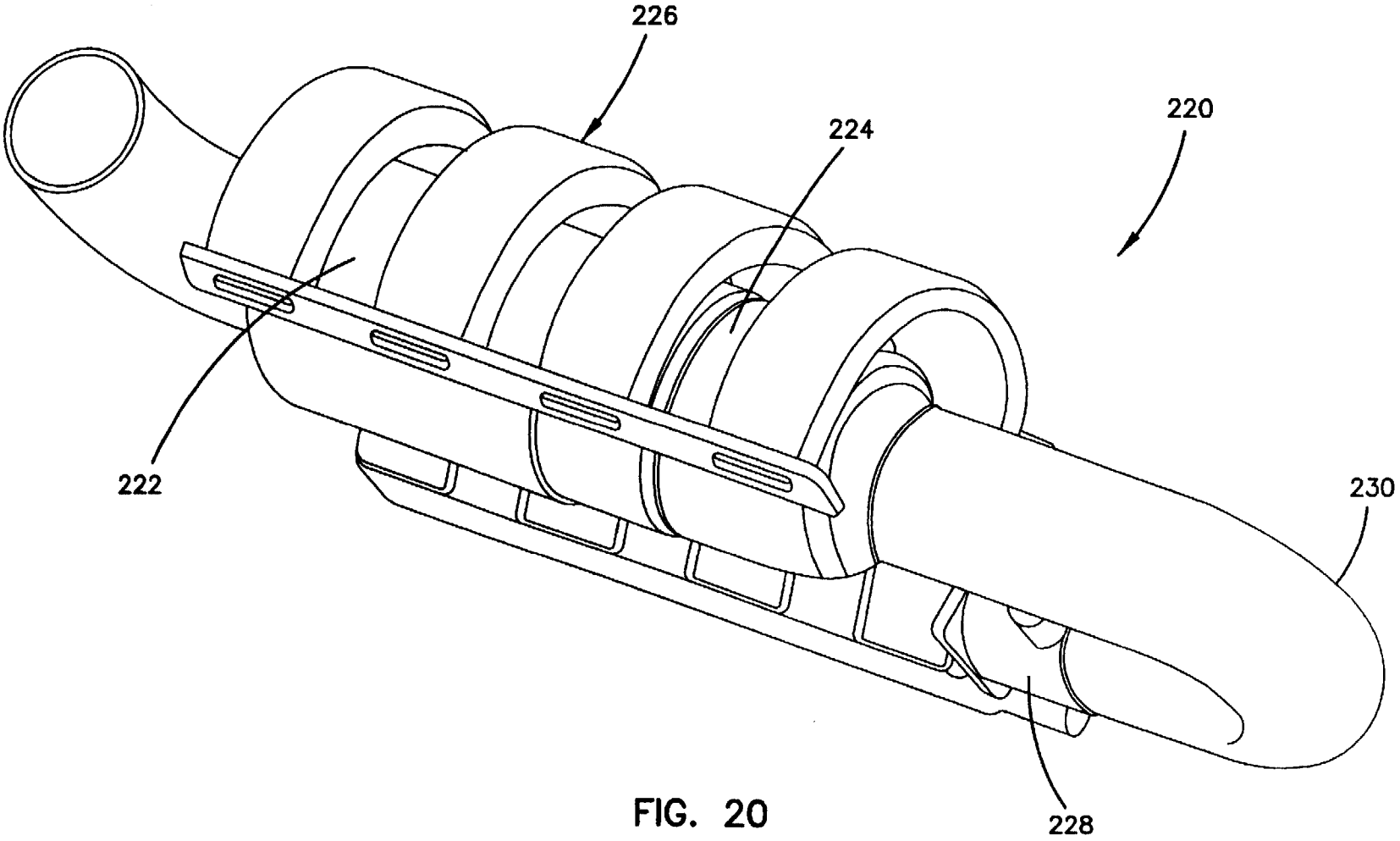
FIG. 20 shows a perspective view of an integrated filter and resonator apparatus integrated into the intake manifold of an internal combustion engine.
Figure 21:
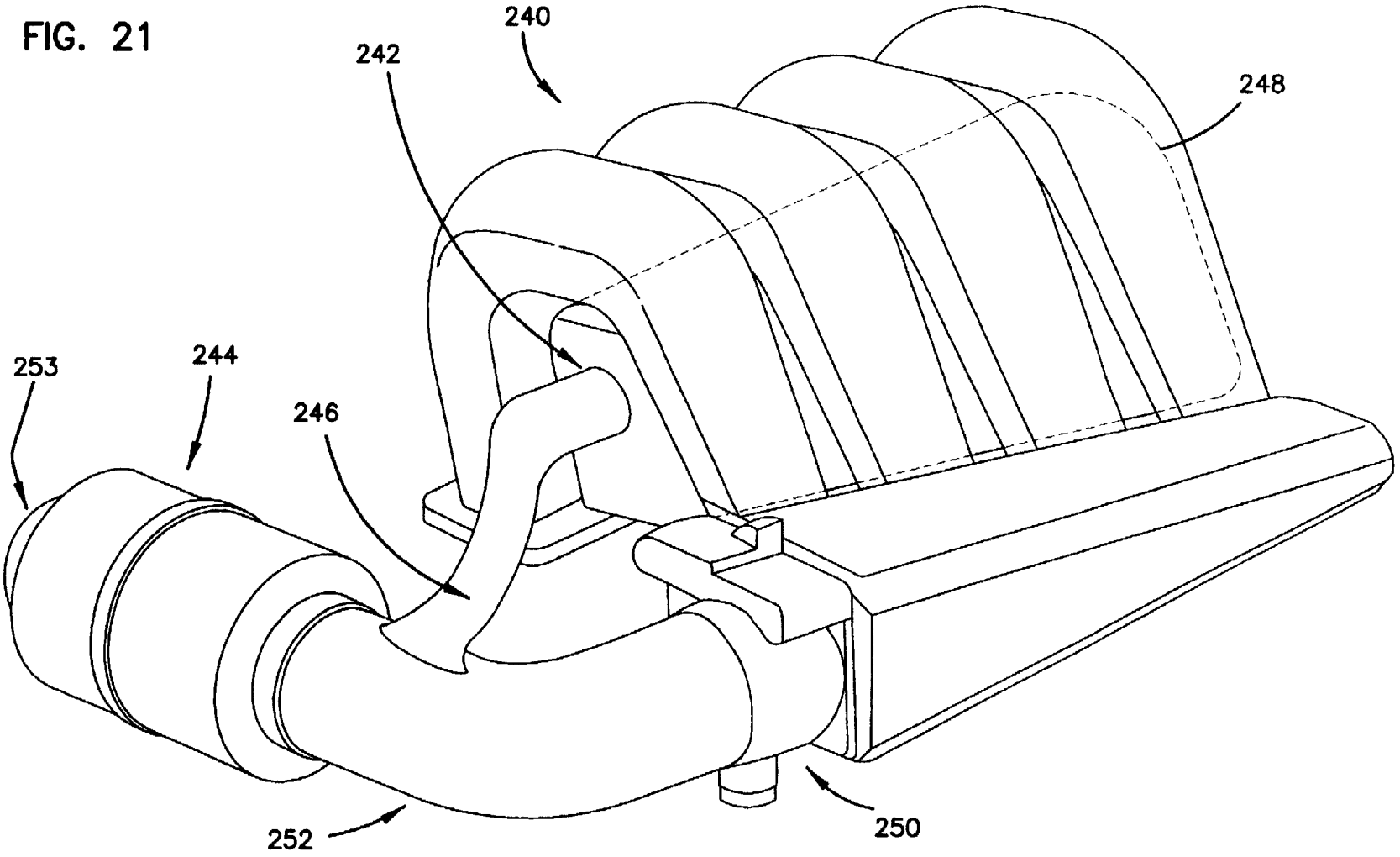
FIG. 21 shows a perspective view of an integral resonator and filter apparatus having the resonator volume integrated into the intake manifold downstream from the filter element.

Referring now to FIGS. 19–21, there are shown embodiments of a filter apparatus mounted in an intake manifold. As shown in FIG. 19, an integral filter/resonator apparatus 200 includes a resonator section 202 with a filter section 204 which may be separate modular components which seat together to form the integral resonator filter unit 200. The resonator-filter apparatus 200 mounts upstream of the engine manifold 206 and the throttle body 208. A duct 210 connects from the throttle body to the outlet side of the resonator 200 so that the resonator is in direct fluid connection to the noise source at the manifold 206. It can be appreciated that in the embodiment shown, the resonator filter apparatus 200 forms a portion of the duct upstream from the manifold 206. In this arrangement, additional space or ductwork to connect to a remote device is not required for filtering or noise reduction. It can also be appreciated that additional ductwork can be connected to the filter element 204 to draw air from a remote location.

Referring now to FIG. 20, there is shown a second embodiment of a resonator and filter apparatus 220, including a filter portion 222 and resonator portion 224 seated together to form the filter and resonator unit 220. The resonator-filter apparatus 220 mounts upstream from the intake manifold 226 and throttle body 228 and is directly connected by a duct 230. In the embodiment shown, the filter and resonator apparatus are part of the duct which extends through the interior of the manifold so that no additional space is required. The manifold runners form the outer layer of the resonator chamber 224 to provide support while reducing the noise radiated by the resonator portion 224. It can be appreciated that the resonator portion 224 is directly connected by the duct 230 to the noise source for improved noise reduction. It can also be appreciated that additional ductwork can be connected to the inlet to draw air from a remote source.

As shown in FIG. 21, another embodiment of a resonator/filter apparatus 240 is shown. The resonator filter apparatus is integrated into the intake manifold 248. In the embodiment shown, the Helmholtz resonator 242 includes a large volume within the arc of the manifold runners. In this manner, the manifold runners form the outer layer of the resonator volume and provide support while reducing the noise radiated by the volume's shell. Similar to other embodiments, the Helmholtz resonator tube joins the intake ducting intermediate the filter 244 and the throttle body 250. Thus, the resonator tube is integral to the intake plenum 252. The filter portion 244 is connected via a tube 246 to the resonator portion 242. The filter and resonator are upstream from the manifold 248 and the throttle body 250 and connected via an intake plenum 252. In the configuration shown, the filter element 244 is directly upstream from the plenum 252 and the manifold 248. It can be appreciated that the space on the interior of the manifold 248 is utilized as a resonator volume so that very little additional space is required. Moreover, the duct upstream from the plenum 252 has the filter element 244 integrated therein so that no additional space is required for the filter.

Figure 22:
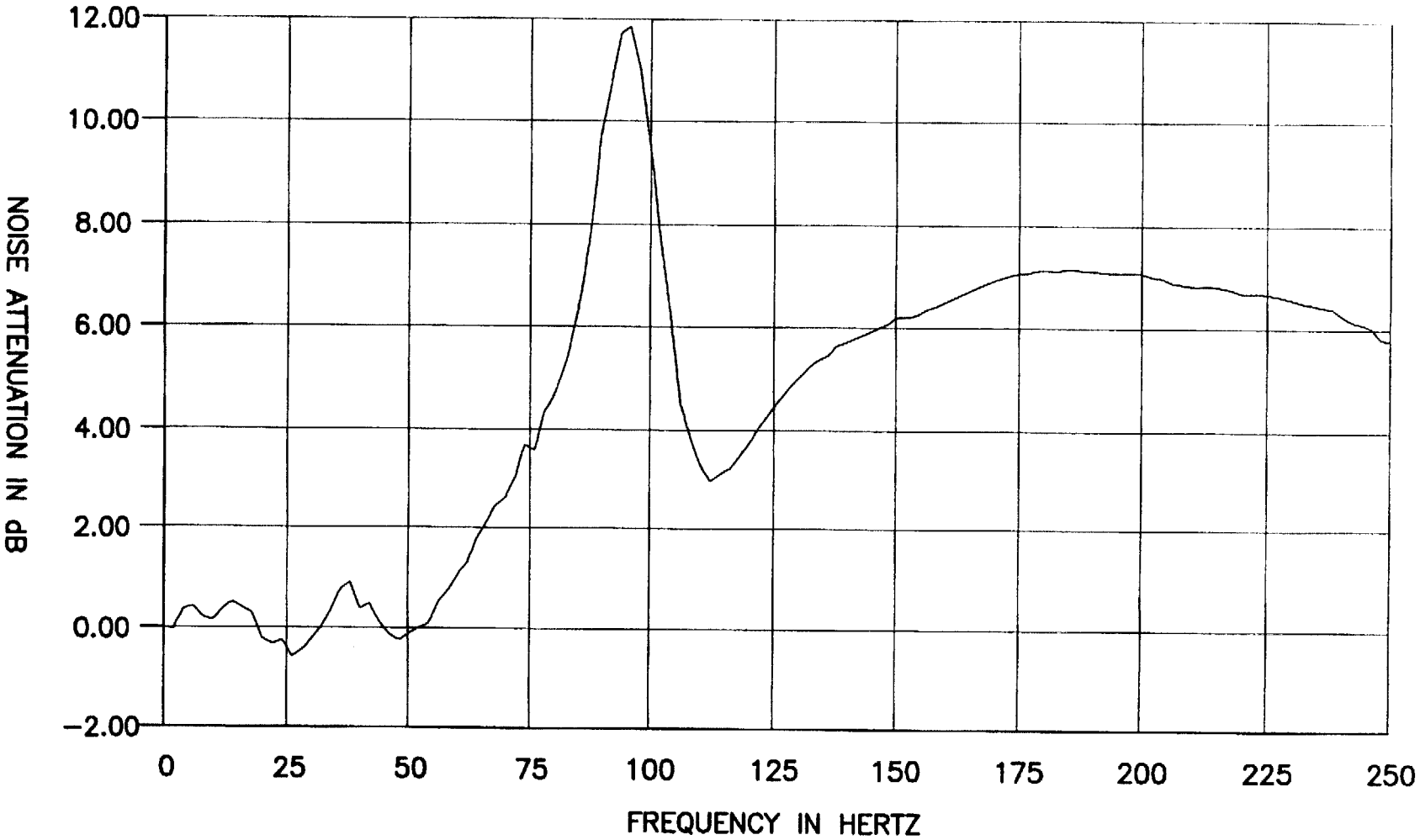
FIG. 22 shows a graph of noise attenuation versus frequency for the resonator apparatus shown in FIG. 14.

Referring now to FIG. 22, there is shown a typical graph of noise attenuation in decibels over a range of frequencies attributed to the Helmholtz resonator structure. It can be appreciated that the loss is substantial, especially in the range between 70 and 100 hertz. The graph is shown for the Helmholtz resonator and filter apparatus 120 shown in FIGS. 14–16. By tuning the resonator structure 122 to match certain wavelengths for noise at corresponding frequencies, the overall noise is greatly reduced. Variation of volumes, lengths, diameters, and relative positions provide for elimination of targeted wave lengths.

If the resonator connecting tube length and volume are of constant area throughout and not prone to enlargements or constrictions, the Helmholtz resonator's peak noise attenuation frequency can be estimated using the relation:

$$\mathrm{TAN}\left(\frac{2\pi f_r l_t}{C}\right)\mathrm{TAN}\left(\frac{2\pi f_r l_v}{C}\right)=A_t/A_v$$

Where

TAN is the trigonometric tangent function $\pi$=3.14159

C=speed of sound $l_t$=connecting tube length $l_v$=length of the volume that sound traverses $A_t$=connecting tube area $A_v$=cross sectional area of the volume $f_r$=maximum noise loss frequency The aforementioned equation can be applied to embodiments 60, 80, 100, 120 and 180.

If the resonator connecting tube or volume changes cross sectional area along the sound propagation length such as embodiment 150, the aforementioned formula cannot be used directly. In this case, the tube, volume and air cleaner must be computer modeled and its performance evaluated to accurately predict the resonant frequency. The aforementioned equation provides an approximation of the resonant frequency for a given volume and connecting tube. An alternative method to computer modeling is prototype construction, test and evaluation.

If the connecting tube and volume lengths are less than one tenth of the wavelength of the noise frequency of maximum loss, the Helmholtz equations, well known to those skilled in the art, can be used to relate the connecting tube length and area, volume and resonant frequency. However, generally this condition is violated by the connecting tube lengths for the embodiments shown and the frequency range of interest.

The attenuation in decibels cannot be estimated accurately because it depends on the flow losses in the connecting tube and entrances between the tube and volume. Test apparatus must be constructed and the attenuation measured.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

We claim:

1. An in-line resonator and filter apparatus comprising:

(a) a housing having an upstream inlet and a downstream outlet;

(b) a fluted filter element positioned within said housing; said filter element including an upstream side and a downstream side; said upstream side being aligned in-line with said inlet;

(c) a resonating chamber positioned within said housing; said resonating chamber comprising a Helmholtz resonator; said resonating chamber being:

(i) downstream of said filter element;

(ii) aligned in-line with said outlet and said downstream side of said filter element; and (iii) integral with said filter element; and (d) a tube construction within the resonating chamber; said tube construction extending between said downstream side of said filter element and said housing outlet.

2. An in-line resonator and filter apparatus according to claim 1 wherein:

(a) said tube construction includes first and second tubes; said first tube being coupled to the downstream side of the filter element; said second tube being coupled to the housing outlet;

(i) said second tube extending coaxially with the first tube and circumscribing the first tube; said second tube opening at an upstream end of said resonating chamber.

3. An in-line resonator and filter apparatus according to claim 2 wherein:

(a) said first tube includes a tubular wall having planar portions.

4. An in-line resonator and filter apparatus according to claim 3 including:

(a) a gasket forming a seal between said filter element and said housing.

* * * * *